US007712176B2

(12) United States Patent
Guenin

(10) Patent No.: US 7,712,176 B2
(45) Date of Patent: May 11, 2010

(54) STYLING BRUSH

(76) Inventor: Dominique Guenin, 50, Cours Georges Clémenceau, F-33000 Bordeaux (FR)

( * ) Notice: Subject to any disclaimer, the term of this patent is extended or adjusted under 35 U.S.C. 154(b) by 0 days.

(21) Appl. No.: 10/559,617

(22) PCT Filed: Jun. 2, 2004

(86) PCT No.: PCT/FR2004/001365

§ 371 (c)(1),
(2), (4) Date: May 26, 2006

(87) PCT Pub. No.: WO2004/107908

PCT Pub. Date: Dec. 16, 2004

(65) Prior Publication Data

US 2007/0012331 A1 Jan. 18, 2007

(30) Foreign Application Priority Data

Feb. 6, 2003 (FR) ..... 03 06603

(51) Int. Cl.
*A47K 7/02* (2006.01)

(52) U.S. Cl. ..... 15/160; 15/201

(58) Field of Classification Search ..... 15/160, 15/145, 164, 169, 186; 132/226, 238, 9, 132/DIG. 5

See application file for complete search history.

(56) References Cited

U.S. PATENT DOCUMENTS

| | | | | |
|---|---|---|---|---|
| 3,962,742 | A * | 6/1976 | Vendur | 15/201 |
| 4,076,032 | A * | 2/1978 | Misercola | 132/212 |
| 4,619,012 | A | 10/1986 | Wachtel | |
| 5,327,611 | A | 7/1994 | Balster | |
| 5,903,950 | A * | 5/1999 | Lavin | 15/172 |
| 5,979,463 | A * | 11/1999 | Santy et al. | 132/120 |
| 2002/0112362 | A1 | 8/2002 | Correa | |
| 2007/0174986 | A1 * | 8/2007 | Park | 15/206 |

FOREIGN PATENT DOCUMENTS

| | | |
|---|---|---|
| EP | 0103205 A1 | 3/1984 |
| EP | 0141532 A1 | 5/1985 |
| FR | 2577774 A1 | 8/1986 |
| GB | 1553261 | 9/1979 |

* cited by examiner

*Primary Examiner*—Lee D Wilson
(74) *Attorney, Agent, or Firm*—William H. Holt

(57) ABSTRACT

A hairbrush for detangling, smoothing, shaping and drying of hair and designed for improving efficiency of a conventional air blow dryer. At least one channel in the head of the brush includes an inlet that is shaped for receiving preferably heated air from a blow dryer and directing the air to exit from an outlet of the channel in an approximately reverse direction closely adjacent to the inlet thereby concentrating the drying action of the heated air.

10 Claims, 5 Drawing Sheets

STYLING BRUSH

Brushes are essential items in hair salons.

Two types of brushes are necessary, i.e. finishing brushes, which are used to smooth the hair once it is dry, and "styling" brushes, which make it possible to give wet hair a shape while drying it.

In essence, to give shape to the hair, it is best to combine a mechanical action, obtained using a "styling" brush, with a thermal action obtained by quickly drying the wet hair held by the brush using a hand dryer that delivers more or less hot air.

The mechanical action in question is a back-and-forth motion of the head of the brush on a lock of wet hair. It is the repetition of this movement that will give this lock a shape—either a straight shape if the head of the brush is simply slid along the hair, or a curly shape if the stylist winds the lock of hair around the head of the brush—and it is the warm or hot air which, through the intensity of the heat and the quantity of air propelled, will more or less quickly give this lock the desired shape.

If a brush is used to intensify the effects of the aeration, it is possible to dry the lock of hair faster, thus saving time, increasing hold and conserving electrical energy.

Conventional brushes, whose heads are generally cylindrical but can also be semi-cylindrical or flat, and which have bristles or tips suitably distributed around a solid part, only allow the lock to be dried on the surface, since the air that reaches the lock dries only the outer part of it, and as a result, their use entails a long drying time.

This disadvantage was recognized by Jean-Louis Wachtel, who proposed a first improvement to the conventional brushes in his patent FR 2,577,774, filed on Feb. 28, 1985. This improvement consists of creating a circulation of air all the way through the head of the brush. As a result, the air that reaches the outer part passes through the thickness of the lock of hair and begins to pre-dry the opposite side of the lock, which does make the brushing operation a little faster.

A brush with a different design, but which also provides for the air current delivered by a hair dryer to pass all the way through its head, is described in the U.S. Pat. No. 5,327,611, granted and published on Jul. 12, 1994 in the name of Melvin Balster et al.

However, in the case of a flat brush, for example like the one described in European patent application no. 0,141,532, filed on Oct. 1, 1984 by the company Denroy Plastics Limited, only the part of the lock of hair in contact with the brush is being dried, and consequently, the circulation of air all the way through the head does not offer any advantage, given that the air passing through the lock of hair on the brush is then propelled into empty space.

One radical solution for intensifying the effects of the aeration would of course be to use an electric blow-brush like the one described in U.S. patent application 2002/0112362, published on Aug. 22, 2002 in the name of M. Correa et al.

However, this type of brush is heavy and hard to handle, and does not seem to exist with a semi-cylindrical head.

Moreover, the simultaneous use of this electric blow-brush and a conventional hair dryer would not be very compatible with the initial energy-saving objective.

It is clear from the prior art that brushes wherein the head can be passed through by the air current delivered by a hand dryer are known, but that to date there is no brush that has the advantage of actually speeding up the drying and shaping process.

The present invention consists of creating dynamics for the air propelled by the hand dryer that are different from those provided by the known brushes, and that make it possible to obtain at least equal styling quality with a time savings that varies between 30% and 50% depending on the shape of the head of the brush. Moreover, since the hair is dried and shaped more rapidly, the hold of the style obtained is improved.

GENERAL DESCRIPTION OF THE INVENTION

The present invention relates to a hairbrush of the type known in the prior art, i.e. comprising a handle and a cylindrical, semi-cylindrical or flat head that extends said handle and comprises surface bristles or tips that are used to detangle, smooth and shape the wet hair during the performance of a styling operation using a dryer generating a first air flow in the direction of said head, said head being at least partially hollowed out and having, at least in the area equipped with bristles or tips, parallelepipedic, cylindrical and/or oblong through-holes, the latter running perpendicular and/or parallel to the longitudinal axis of the brush.

According to the invention, a brush of the aforementioned type is characterized in that the axes of the two openings of each of said through-holes form between them an angle of less than 90° so that the air propelled by said dryer and circulating inside said head emerges in the vicinity of each of said openings through which it entered, thus constituting a second flow in a direction approximately opposite that of the first flow.

In the case of a hairbrush comprising a cylindrical or semi-cylindrical head, the axes of the two openings of each of said through-holes advantageously form between them an angle between 30° and 60°.

In the case of a hairbrush comprising a flat head, the axes of the two openings of each of said through-holes advantageously form between them an angle between 30° and 60° and open on the same side of the head.

These various structures have the common advantage of practically doubling the flow of air propelled by the hairdryer, in the sense that the original flow from the dryer dries the lock of hair from the outside (or the top), then penetrates inside the brush, and finally emerges through one or more through-holes provided in the head of the brush, thereby drying the inside (or the bottom) of the lock of hair. Thus, the brush according to the invention allows the formation of two laminar drying flows of approximately equal power, a first on the outside, coming from the drier, and a second on the inside, coming from the head of the brush.

In a first variant of embodiment, the head of the brush comprises at least one recess that runs parallel to its longitudinal axis and is closed at its two transverse ends and, disposed inside said recess in an approximately axial plane, an insert composed of a longitudinal bar whose ends are fastened into the transverse end walls of the head of the brush, the top edge of said bar being located approximately in the virtual extension of the surface of the area of the head in which the recess is formed, while its bottom edge is apart from the bottom of the recess, the bar being extended transversely in the form of multiple, evenly spaced parallel branches whose top edge is located approximately in the virtual extension of the surface of the head and whose bottom edge rests against the bottom of the recess.

According to a first embodiment of the aforementioned variant, the area of each opening existing between the bottom edge of the bar and the bottom of the recess is equal to that of the openings delimited between two successive branches, the bar, and the opposing edge of the recess.

According to a second embodiment of said variant, the area of each opening existing between the bottom edge of the bar and the bottom of the recess is smaller than that of at least one of the two openings delimited between two successive branches, the bar and the opposing edge of the recess.

Advantageously, the areas of the openings delimited between two successive branches, the bar and the opposing edge of the recess are different. In the latter case, the head of the brush comprises at least two recesses and, disposed inside each recess, an insert composed of a longitudinal bar extended transversely by multiple parallel branches, and said openings of each recess that are nearest the other recess have an area larger than that of the openings of the first recess that are farthest from the other recess.

In another variant of embodiment of the invention for which the head of the brush is hollow, an approximately median longitudinal partition, connected along its two longitudinal edges to the lateral wall of the head, runs through the interior of said hollow head from one end of the latter to the other so as to divide said interior into two chambers of approximately equal volume, and the lateral wall of the head is pierced with four longitudinal slots that open in pairs into each chamber.

In another variant for which the head of the brush is also hollow and cylindrical, at least three longitudinal radial partitions are advantageously provided, running through the interior of said hollow head from one end of the latter to the other so as to divide said interior into at least three chambers of approximately equal volume, and the lateral wall of the head in this case is pierced with at least six longitudinal slots that open in pairs into each chamber.

The detailed specifications of the invention are given in the following description in connection with the attached drawings. It should be mentioned that the purpose of these drawings is merely to illustrate the text of the description, and they do not in any way constitute a limitation of the scope of the invention.

DESCRIPTION OF THE PREFERRED EMBODIMENTS OF THE INVENTION

Figure 1:
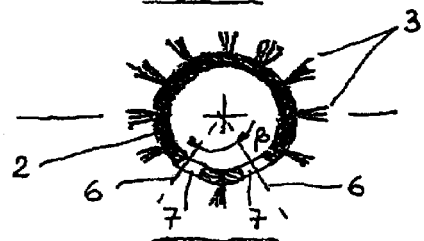
FIG. 1 is a cross-sectional view of the head of a round brush according to the invention.

The present invention concerns a hairbrush with a cylindrical, semi-cylindrical or flat head, closed at its two transverse ends and having a plurality of openings that make it possible, according to the invention, to create an original and improved dynamic effect of the air propelled by a hand dryer.

Conventionally, this brush is composed of a handle 1 that allows the tool to be manipulated, in the extension of which is attached the head 2, i.e., the part used to smooth or wind the hair and give it the desired shape.

This head 2 has inserted bristles or tips 3 used for smoothing and shaping the hair.

The present invention applies equally to hairbrushes wherein the head 2, which is at least partially hollowed out, is cylindrical, semi-cylindrical, or flat and has, at least in the area equipped with bristles or tips 3, through-holes 5 that are either parallelepipedic, cylindrical, or oblong, the latter running perpendicular and/or parallel to the longitudinal axis 4 of the brush.

Figure 12:
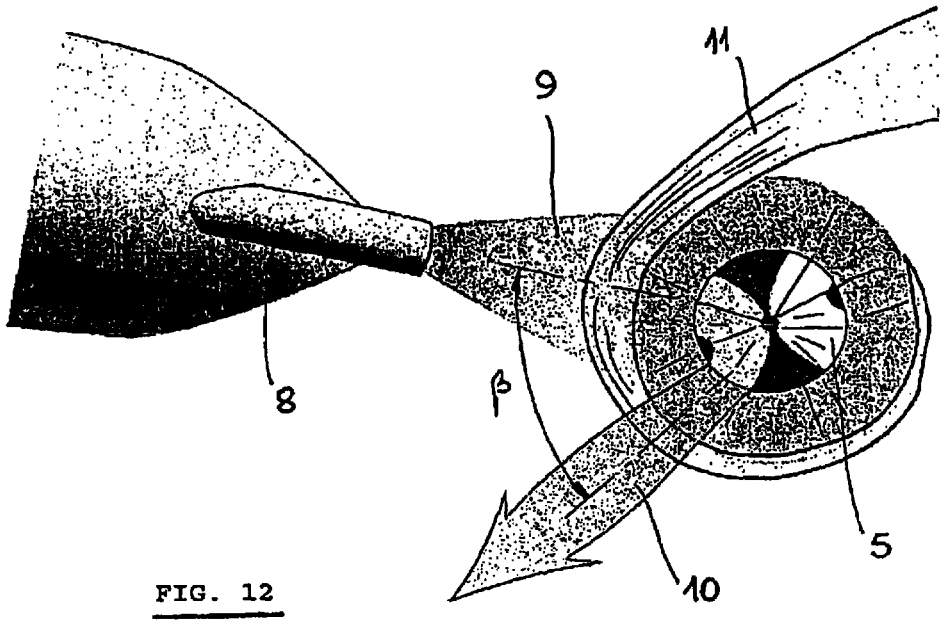
FIGS. 10, 11 and 12 illustrate the operating modes of three brushes with cylindrical heads, respectively, the first one being solid and passed all the way through by the air current delivered by a hairdryer, the second one being in accordance with the prior art, and the last one corresponding to the invention.

According to its main characteristic, the brush according to the invention is noteworthy in that the axes 6 of the two openings 7 of each of the through-holes 5 form between them an angle β of less than 90° (see FIGS. 1 and 12).

Thus, the air flow 9 propelled by the dryer 8. which dries the lock of hair 11 from the top, then penetrates into the interior of the head of the brush through a first opening 7 of the through-hole 5, will emerge at 10, thus also drying the lock of hair 11 from the bottom, as though the second air flow 10 were being propelled by the head 2 of the brush.

For the aforementioned purposes, the angle β is advantageously between 30° and 60° and is preferably close to 45°.

Figure 4:
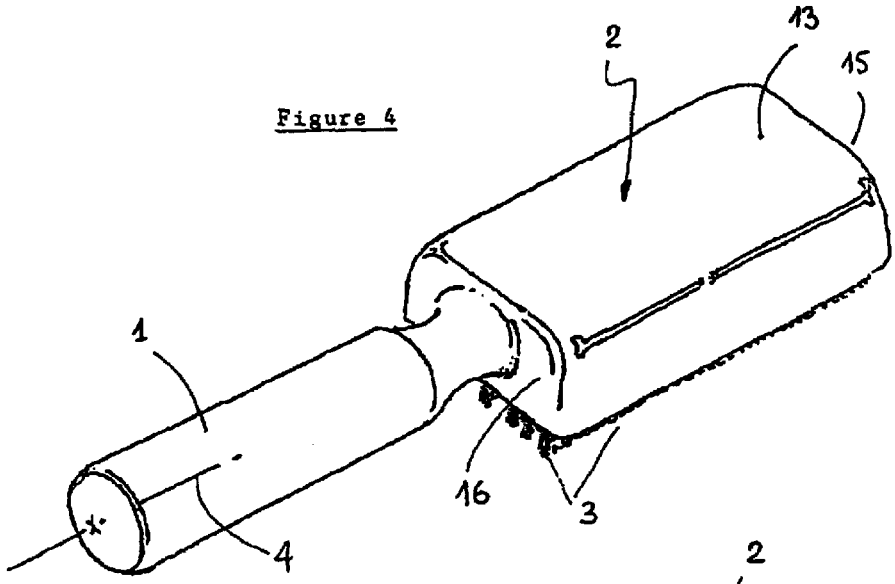
FIG. 4 is a back view of a flat-headed brush according to the invention.
Figure 5:
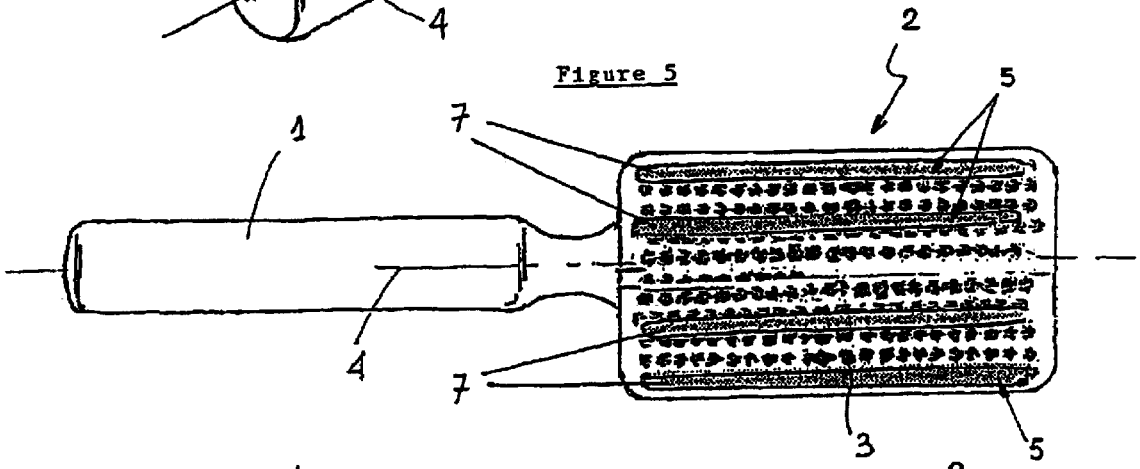
FIG. 5 is a top view of the flat brush in FIG. 4 showing the longitudinal openings or slots having the characteristics of the invention.
Figure 6:
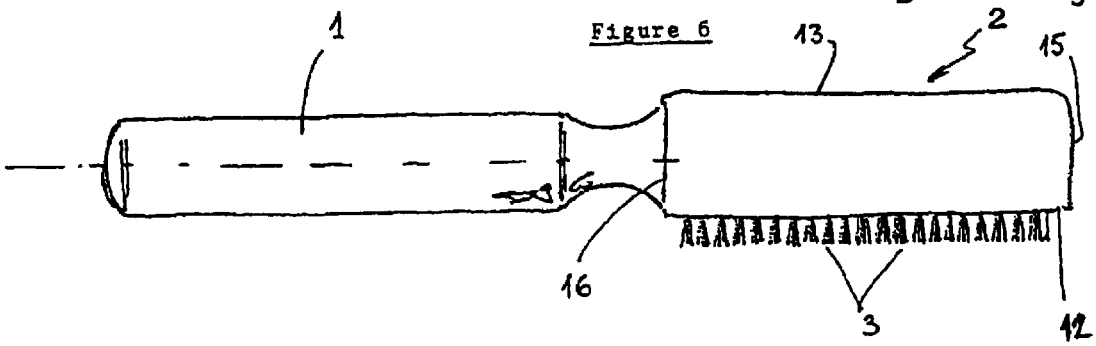
FIG. 6 is a side view of the flat brush represented in FIGS. 4 and 5.

In the case of a flat-headed brush like the one represented in FIGS. 4 through 6, the two openings 7 of each through-hole 5 open on the same side 12 of the head 2, i.e., the side equipped with bristles 3, thus leaving the back 13 of the head of the brush solid.

Figure 7:
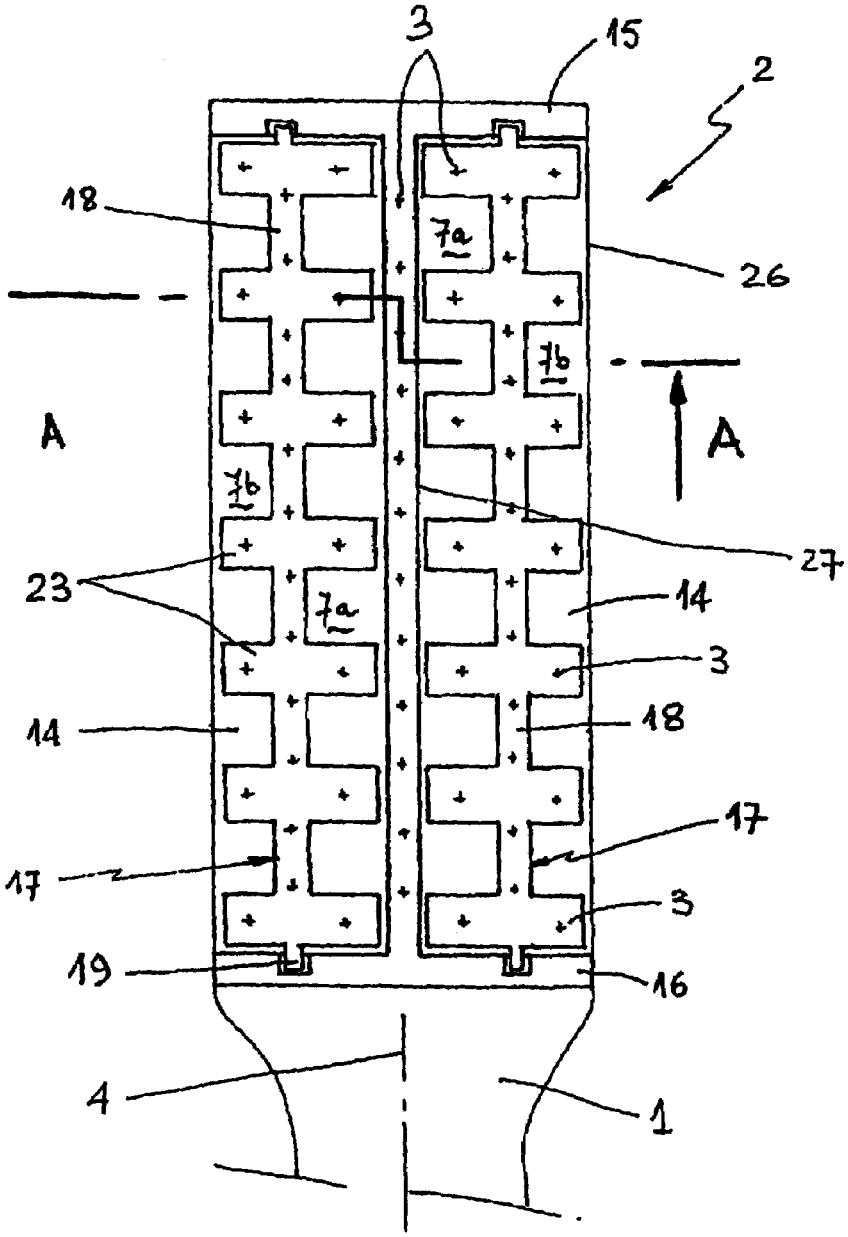
FIG. 7 is a top view of a brush with a semi-cylindrical head according to the invention, equipped with two inserts.
Figure 8:
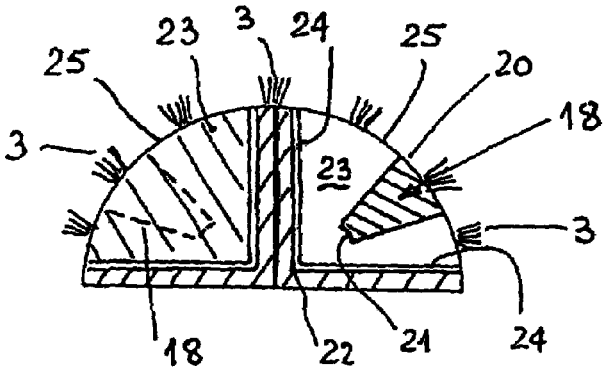
FIG. 8 is a view along the cut line A-A of the brush with a semi-cylindrical head in FIG. 7.

In another variant of embodiment illustrated in FIGS. 7 and 8, the head 2 of the brush according to the invention comprises at least one recess 14 (in this case two recesses) which runs parallel to the longitudinal axis 4 and is closed at its two transverse ends, respectively the front end 15 and the rear end 16.

Disposed inside each recess 14, in an approximately axial plane, is an insert 17 composed of a longitudinal bar 18 whose ends 19 are embedded, for example snapped, into the end walls 15 and 16 of the head 2 of the brush.

The top edge 20 of the bar 18 is located approximately in the virtual extension of the surface of the area of the head in which the recess 14 is formed while its bottom edge 21 is apart from the bottom 22 of the recess.

The bar 18 is extended transversely in the form of multiple parallel and evenly spaced branches 23. The top or outer edge 25 of each branch 23 is located approximately in the virtual extension of the surface of the head and the bottom or inner edge 24 of said branch rests against the bottom of the recess 14 so that each branch 23 thus constitutes an isolating partition.

Thus, each insert 17 forms with the recess 14 into which it is integrated a plurality of through-holes 5 (six in the embodiment represented in FIG. 7), the axes 6 of the two openings 7 of each of such through-holes forming between them an angle of close to 50°.

Various structures are conceivable for the inserts 17.

To give a first example, the area of each opening existing between the bottom edge 21 of the bar 18 and the bottom 22 of the recess is equal to the area of the openings delimited between two successive branches 23, the bar 18, and the opposing edge of the recess, respectively 26 and 27. In this case, the through-hole has a constant cross-section and the air flow for drying the lock of hair is subject to practically no variation.

To give a second example, the area of each opening existing between the bottom edge 21 of the bar 18 and the bottom 22 of the recess 14 is smaller than that of at least one of the two openings delimited between two successive branches 23, the bar 18 and the opposing edge of the recess, respectively 26 and 27. In this embodiment, the cross-section of the through-hole decreases, then increases so that the air blown by the dryer is first compressed and then expands.

To give a third example, illustrated in FIGS. 7 and 8, the areas of the openings delimited between two successive branches 23, the bar 18 and the opposing edge 26, 27 of the recess 14 are different. The head 2 of the brush in this case advantageously comprises at least two recesses 14 and, disposed inside each recess, an insert 17 composed of a longitudinal bar 18 extended transversely by multiple parallel branches 23, the openings 7*a* of each recess that are nearest the other recess having an area larger than that of the openings 7*b* of the first recess that are furthest from the other recess. In this type of embodiment, each through-hole 5 acts like a nozzle. A brush according to this embodiment can be used by right-handers or left-handers, both for pushing and pulling on the brush.

In all of the preceding embodiments, the through-holes 5 are separated from one another in order to make the air penetrate and circulate through the interior of the brush so that this air, propelled by the dryer, emerges from the head of the brush in the vicinity of the opening through which it entered.

Figure 2:
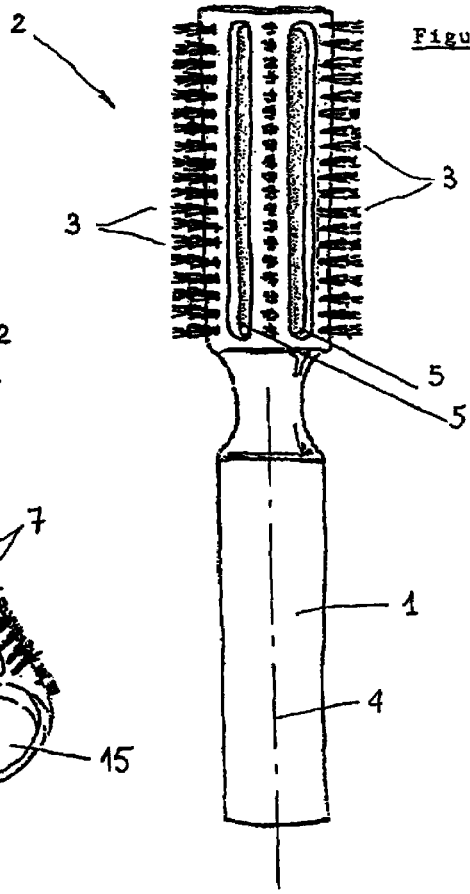
FIG. 2 is a top view of the round brush of FIG. 1 showing two longitudinal openings that allow the air to pass through and emerge as close as possible to the inlet opening.
Figure 3:
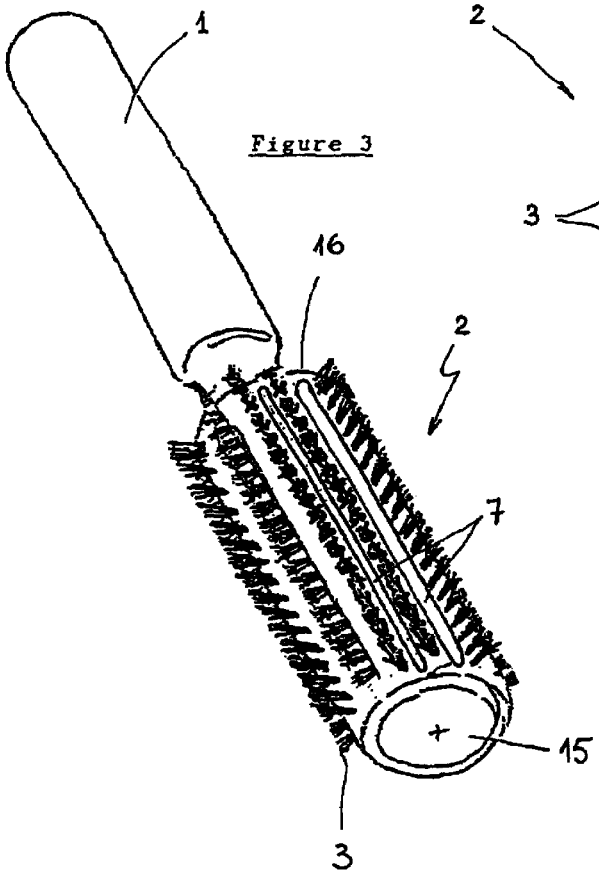
FIG. 3 is a view in perspective of the round brush in FIGS. 1 and 2 showing the closed end of the head of the brush and two longitudinal openings of different widths.

The through-holes 5 are generally transverse, as represented in FIGS. 7, 8 and 12, but they can also run longitudinally. The through-holes can also be produced so that they have a crescent-shaped cross-section and so that they emerge from the wall of the head 2 in the form of longitudinal slots, as represented for example in FIGS. 2 and 3.

The longitudinal slots 7, which are provided in pairs, can have the same surface areas (FIG. 2) or different surface areas (FIG. 3), in which case, as in the aforementioned example, the air leaving the head of the brush will also be compressed, resulting in a further improved drying action.

In the case of brushes with semi-cylindrical or flat heads, the total surface area of the openings 7 represents approximately ¼ of the total lateral surface area of the head, and in the case of brushes with cylindrical heads, the total surface area of the openings 7 will advantageously be between ⅕ and ⅐ of the total surface area of the head.

Figures 9A, 9B, 9C:
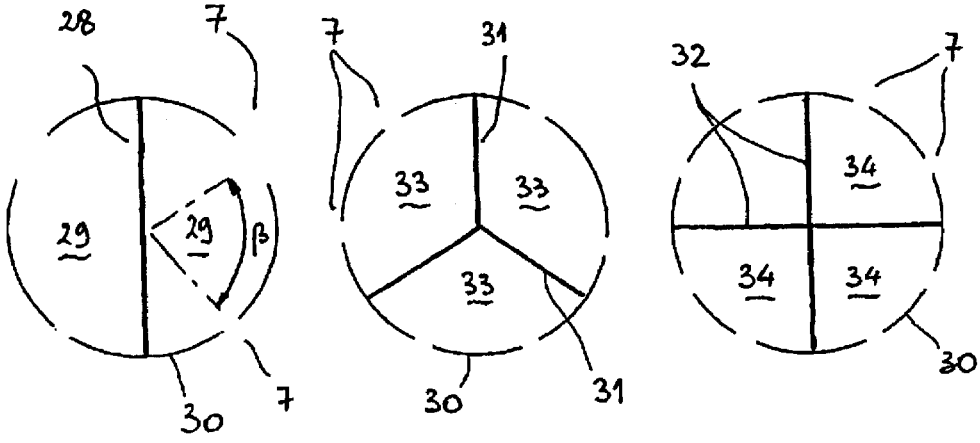
FIGS. 9*a*, 9*b* and 9*c* represent in cross-section three other embodiments of a brush with a cylindrical head according to the invention.

According to other embodiments represented in FIGS. 9*a* through 9*c*, the head of the brush according to the invention is hollow and receives an approximately median longitudinal partition 28, connected along its two longitudinal edges to the lateral wall 30 of the head and running through the interior of said hollow head from one end 15 of the latter to the other 16 so as to divide said interior into two chambers 29 of approximately equal volume.

The lateral wall 30 of the head is pierced with four longitudinal slots 7 that open in pairs into each chamber 29.

This embodiment, represented in FIG. 9*a*, applies to brushes with cylindrical, semi-cylindrical or flat heads.

In the case of a cylindrical head, the hollow head can receive three longitudinal radial partitions 31, or four partitions 32 that run through the interior of the head 2 from one end 15 of the latter to the other 16 and that thereby respectively divide said interior into three chambers 33 or four chambers 34 of approximately equal volume.

In each case, the lateral wall 30 of the head is pierced with slots that open in pairs into each chamber, which number six in the example represented in FIG. 9*b* and eight in the example represented in FIG. 9*c*.

The slots can either be of equal width (FIGS. 9*b* and 9*c*), or of different widths (FIG. 9*a*).

Figure 10:
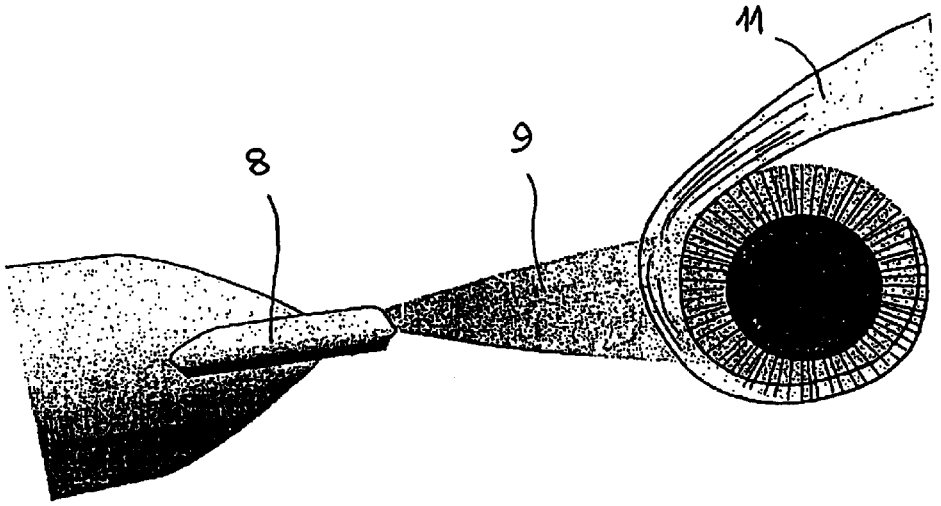
Figure 11:
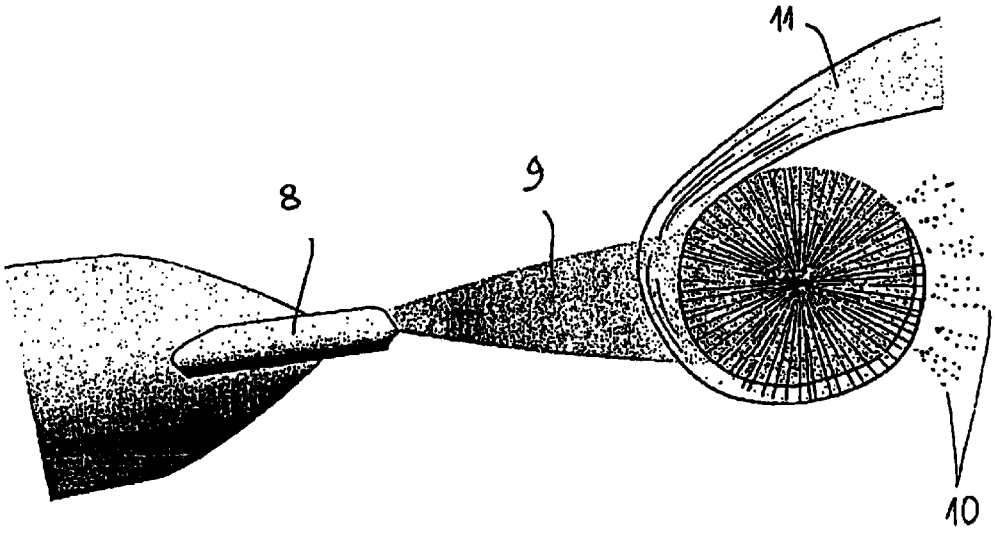

By referring to FIGS. 10 through 12, it is possible to observe the different action of three brushes depending on whether their head is solid, is passed all the way through, or corresponds to the invention.

In the first case, the air flow dries only the hair placed in front of the brush, the air being blocked by its core.

In the second case, the air flow dries the hair from the top, passes through the brush and slightly pre-dries the part of the lock of hair that is located on the other side. It should be mentioned that this pre-drying does not exist in the case of brushes with semi-cylindrical or flat heads.

In the third case according to the invention, the air flow dries the hair from the top, penetrates into the interior of the brush and emerges from it with power, as though there were a second air flow for drying the lock of hair from the bottom.

The invention claimed is:

1. A hairbrush comprising a handle (1) and a head (2) that extends from said handle and comprises surface bristles (3) that are used to detangle, smooth and shape wet hair (11) during the performance of a styling operation using a dryer (8) generating a first air flow (9) in the direction of said head (2), said head (2) being at least partially hollowed out and having, at least in the area equipped with said bristles (3), through-holes including an inlet and an outlet, said through-holes running perpendicular or parallel to a longitudinal axis (4) of said brush, characterized in that the axes (6) of said inlet and outlet of said through-holes (5) form between them an angle of less than 90° so that the air propelled by said dryer (8) and circulating inside said head (2) emerges in the vicinity of said inlet through which said air entered, thus constituting a second flow (10) in a direction approximately opposite that of said first flow (9), characterized in that said head (2) comprises at least one recess (14) that runs parallel to a longitudinal axis (4) and is closed at two transverse ends (15, 16) thereof and, disposed inside said recess in an approximately axial plane, an insert (17) composed of a longitudinal bar (18) whose ends (19) are fastened into the transverse end walls (15, 16) of the head of said brush, the top edge (20) of said bar being located approximately in the virtual extension of the surface of the area of the head in which said recess is formed, while a bottom edge (21) is spaced apart from the bottom (22) of said recess, said bar (18) being extended transversely in the form of multiple, evenly spaced parallel branches (23) whose top edge (25) is located approximately in the virtual extension of the surface of the head and whose bottom edge rests against the bottom of the recess.

2. A hairbrush according to claim 1, characterized in that the area of each opening existing between the bottom edge (21) of the bar (18) and the bottom (22) of the recess (14) is equal to that of the openings delimited between adjacent ones of said branches (23), the bar (18), and the opposing edge (26, 27) of the recess.

3. A hairbrush according to claim 1, characterized in that the area of each opening existing between the bottom edge (21) of the bar (18) and the bottom (22) of the recess (14) is smaller than that of at least one of the two openings delimited between adjacent ones of said branches (23), the bar (18) and the opposing edge (26, 27) of the recess.

4. A hairbrush according to claim 1, characterized in that the areas of the openings delimited between adjacent ones or said branches (23), the bar (18) and the opposing edge (26, 27) of the recess are different.

5. A hairbrush according to claim 4, characterized in that said head comprises at least two recesses (14) and, disposed inside each recess, an insert (17) composed of a longitudinal bar (18) extended transversely by multiple parallel branches (23), and in that said openings (7*a*) of each recess (14) that are nearest the other recess have an area larger than that of the openings (7*b*) of the first recess that are farthest from the other recess.

6. A hairbrush comprising a handle (1) and a head (2) that extends from said handle and comprises surface bristles (3) that are used to detangle, smooth and shape wet hair (11) during the performance of a styling operation using a dryer (8) generating a first air flow (9) in the direction of said head (2), said head (2) being at least partially hollowed out and having, at least in the area equipped with said bristles (3), through-holes including an inlet and an outlet, said through-holes running perpendicular or parallel to a longitudinal axis (4) of said brush, characterized in that the axes (6) of said inlet and outlet of said through-holes (5) form between them an angle of less than 90° so that the air propelled by said dryer (8) and circulating inside said head (2) emerges in the vicinity of said inlet through which said air entered, thus constituting a second flow (10) in a direction approximately opposite that of said first flow (9) characterized in that said head (2) is hollow and cylindrical, in that at least three longitudinal radial partitions (31, 32) run through the interior of said hollow head from one end (15) of the latter (16) to the other so as to divide said interior into at least three chambers (33, 34) of approximately equal volume, and in that the lateral wall (30) of the head is pierced with at least six longitudinal slots (7) that open in pairs into each chamber.

7. A hairbrush comprising a handle (1) and a head (2) that extends from said handle and comprises surface bristles (3) that are used to detangle, smooth and shape wet hair (11) during the performance of a styling operation using a dryer (8) generating a first air flow (9) in the direction of said head (2), said head (2) being at least partially hollowed out and having, at least in the area equipped with said bristles (3), through-holes including an inlet and an outlet, said through-holes running perpendicular or parallel to a longitudinal axis (4) of said brush, characterized in that said head (2) of the brush comprises at least one longitudinal airtight partition (28, 31, 32) and that the axes (6) of said inlet and outlet of said through-holes (5) form between them an angle of less than 90° so that the air propelled by said dryer (8) and circulating inside said head (2) emerges in the vicinity of said inlet through which said air entered, thus constituting a second flow (10) in a direction approximately opposite that of said first flow (9).

8. A hairbrush according to claim 7, comprising a cylindrical or semi-cylindrical head (2), characterized in that the axes (6) of the two openings (7) of each of said through-holes (5) advantageously form between them an angle between 30° and 60°.

9. A hairbrush according to claim 7, comprising a flat head (2), characterized in that the axes (6) of the two openings (7) of each of said through-holes (5) advantageously form between them an angle between 30° and 60° and open on the same side (12) of the head.

10. A hairbrush according to claim 7, characterized in that said head (2) is hollow, in that an approximately median longitudinal partition (28), connected along two edges longitudinal to the lateral wall of the head, runs through the interior of said hollow head from one end (15) of the latter to the other (16) so as to divide said interior into two chambers (29) of approximately equal volume, and in that the lateral wall (30) of the head is pierced with four longitudinal slots (7) that open in pairs into each chamber.

* * * * *